United States Patent [19]

Hardy et al.

[11] Patent Number: 5,040,119

[45] Date of Patent: Aug. 13, 1991

[54] DRAFT CONTROL APPARATUS AND METHOD

[75] Inventors: Gerald D. Hardy, Metamora; John P. Hoffman; Larry E. Kendrick, both of Peoria; Stephen W. Rector, Metamora, all of Ill.

[73] Assignee: Caterpillar Inc., Peoria, Ill.

[21] Appl. No.: 505,284

[22] Filed: Apr. 5, 1990

[51] Int. Cl.[5] ..... H01B 63/112

[52] U.S. Cl. ..... 364/424.07; 172/4; 172/8

[58] Field of Search ..... 364/424.07, 150, 151, 364/571.07; 172/4, 4.5, 7, 8, 10

[56] References Cited

U.S. PATENT DOCUMENTS

| | | | |
|---|---|---|---|
| 4,490,791 | 12/1984 | Morrison | 364/151 |
| 4,495,577 | 1/1985 | Strunk et al. | 364/424.07 |
| 4,796,712 | 1/1989 | Rutkowski et al. | 172/7 |
| 4,807,136 | 2/1989 | Rutkowski et al. | 364/424.07 |
| 4,846,283 | 7/1989 | Batcheller | 172/10 |
| 4,866,641 | 9/1989 | Nielsen et al. | 364/424.07 |

*Primary Examiner*—Thomas G. Black
*Attorney, Agent, or Firm*—Stephen L. Noe

[57] ABSTRACT

Implement draft control devices are typically utilized on agricultural vehicles such as tractors and on other earthworking type vehicles. Advantageously, such control systems should respond quickly to changing soil conditions, while remaining stable so that the hitch and implement systems do not oscillate or are not changed in a rapid or erratic fashion. The instant embodiment of a draft control system includes a control system that receives hitch position control signals and engine acceleration signals, and controllably modifies the hitch position control signals in response to the rate of acceleration and deceleration of the engine. By utilizing engine acceleration and deceleration rates as opposed to mere changes in engine speed, the system is able to respond quickly to needed changes in implement depth while remaining stable during operation.

13 Claims, 6 Drawing Sheets

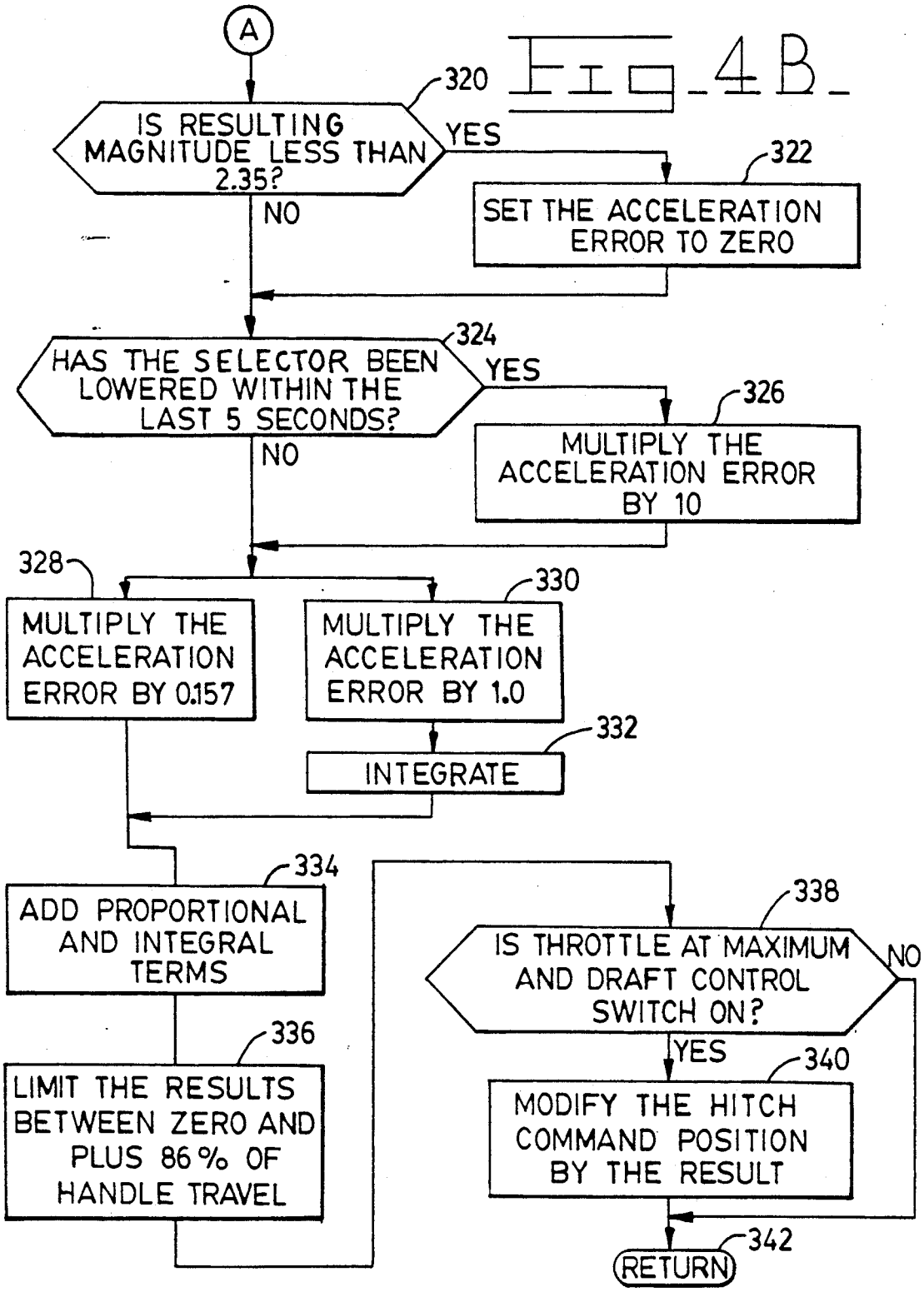
A
Fig. 4B
320
IS RESULTING MAGNITUDE LESS THAN 2.35?
YES
NO
322
SET THE ACCELERATION ERROR TO ZERO
324
HAS THE SELECTOR BEEN LOWERED WITHIN THE LAST 5 SECONDS?
YES
NO
326
MULTIPLY THE ACCELERATION ERROR BY 10
328
MULTIPLY THE ACCELERATION ERROR BY 0.157
330
MULTIPLY THE ACCELERATION ERROR BY 1.0
332
INTEGRATE
334
ADD PROPORTIONAL AND INTEGRAL TERMS
336
LIMIT THE RESULTS BETWEEN ZERO AND PLUS 86% OF HANDLE TRAVEL
338
IS THROTTLE AT MAXIMUM AND DRAFT CONTROL SWITCH ON?
NO
YES
340
MODIFY THE HITCH COMMAND POSITION BY THE RESULT
342
RETURN

DRAFT CONTROL APPARATUS AND METHOD

TECHNICAL FIELD

This invention relates generally to an apparatus and method for controlling the draft of an implement connected to an earthworking vehicle and more particularly, to an apparatus and method for controllably modifying the draft of the earthworking implement in response to acceleration and deceleration of the associated vehicle engine.

BACKGROUND ART

Various systems have been developed for controlling the draft of an implement associated with an earthworking vehicle, such as an agricultural or construction type tractor. Implement draft is generally defined as the force required to push or pull the implement, and is responsive to the depth of penetration of the implement into the soil. Most such prior systems provide controls by which an operator can select a desired implement penetration depth. This depth position is normally maintained by the control system unless some predetermined working condition requires that the depth be modified. In the most common situation, the control system monitors one or more selected working conditions, such as vehicle speed or draft force, and modifies the implement penetration in response to the working condition.

One example of such a prior control system is found in U.S. Pat. No. 4,495,577, issued Jan. 22, 1985, to Strunk, et al. Strunk teaches a system for controlling the working depth of an implement pulled by an agricultural vehicle. The system senses engine speed, implement created draft force, and implement or hitch position. Based on these sensed values, the system modifies the depth of implement penetration in an attempt to most efficiently operate the vehicle. Strunk does recognize one important factor that must be considered when attempting to automatically control implement draft. Draft control systems with fixed gain characteristics do not function well under varying soil conditions. When the soil is compact and difficult to work, a particular gain setting may be too high, resulting in implement oscillation or instability. However, the same gain setting may prove to be too low and unresponsive to different conditions in which the soil is less compact. Therefore, many draft control systems are difficult to utilize because multiple settings of gain and other control characteristics have to be made in a somewhat intuitive manner by the operator. Such systems are simply not suited to actual field working conditions.

Recognizing that stability of the control system is necessary for proper operation, Strunk considers a plurality of working condition factors in the described control algorithm. However, the Strunk system still does not achieve optimum control stability because it is only able to react after a particular error condition has been sensed, and is not able to predictively modify the characteristics of the control algorithm.

The present invention is directed to overcoming the various problems associated with implement draft control, including the shortcomings of the Strunk disclosure.

DISCLOSURE OF THE INVENTION

In one aspect of the present invention, a draft control apparatus for an earthworking vehicle is provided. The vehicle includes an engine responsive to an engine throttle and a hitch connectable to an earthworking implement. The hitch is also connectable to the vehicle and is controllably movable between raised and lowered positions in response to hitch position control signals. A command device produces a desired engine acceleration signal and an acceleration determining device produces an actual engine acceleration signal. A control receives the desired and actual engine acceleration signals, produces a responsive acceleration error signal, and controllably modifies the hitch position control signals in response to the acceleration error signal.

In a second aspect of the present invention, a method for controlling the draft of an earthworking vehicle is provided. The earthworking vehicle includes an engine responsive to an engine throttle and a hitch connectable to an earthworking implement. The hitch is also connectable to the vehicle and is controllably movable between raised and lowered positions in response to hitch position control signals. The method includes the following steps: Desired and actual engine acceleration signals are produced. The desired and actual engine acceleration signals are then processed to determine an acceleration error signal and the hitch position control signals are controllably modified in response to the acceleration error signal.

The present invention provides a vehicle draft control system that is advantageously responsive to the acceleration and deceleration of the vehicle engine. Therefore, the draft control system is able to respond quickly to changes in implement draft and vehicle loading while operating in a stable mode at all times.

BRIEF DESCRIPTION OF THE DRAWINGS

For a better understanding of the present invention, reference may be made to the accompanying drawings, in which:

FIG. 3 is a schematic diagram of the engine acceleration determining portion of the system described in FIGS. 2A and 2B; and FIGS. 4A and 4B are flowcharts of software used to implement the embodiment described in FIGS. 2A and 2B.

BEST MODE FOR CARRYING OUT THE INVENTION

Figure 1:
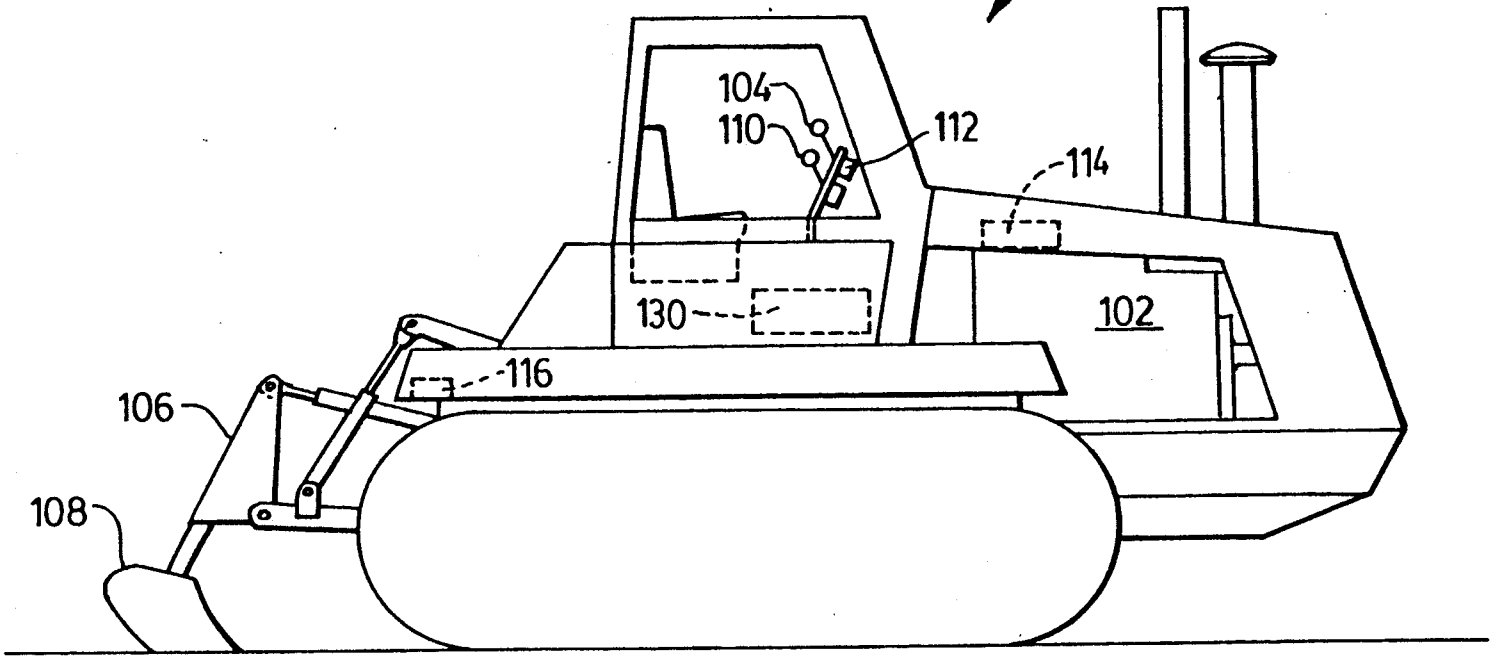
FIG. 1 is a stylized side view of an earthworking vehicle having an engine and an earthworking implement connected to a hitch on the vehicle.

Referring first to FIG. 1, a vehicle of the general type that would benefit from use of the present invention is generally indicated by the reference numeral 100. The vehicle 100 is, for example, an earthworking vehicle such as an agricultural tractor having a belt type ground engaging drive system, and includes an engine 102. The operating speed of the engine 102 responsive to an engine throttle 104, which is controllably settable by an operator. A hitch 106 is connected to the vehicle 100, and an earthworking implement 108 is connected to the hitch 106. The hitch 106 is controllably movable between raised and lowered positions in response to hitch position control signals.

A hitch position selector 110 is movable to a plurality of hitch position command positions. Movement of the hitch position selector 110 produces hitch position control signals which are delivered to actuating elements such as hydraulic cylinders, which in turn move the hitch 106 relative to the vehicle 100. This manner of positioning an earthworking implement is common and has been used on earthworking vehicles for many years.

A first transducer means 112 is provided for sensing the position of the engine throttle 104 and for producing signals responsive to the position of the engine throttle 104.

A second transducer means 114 senses the vehicle engine speed and responsively produces actual engine speed signals. Engine speed or rpm transducers have been common on vehicles for many years and selection of such a transducer is a matter of design choice and forms no part of the present invention.

A hitch control means 116 operates in cooperation with the hitch position selector 110 to actuate the hitch 106 and move it between raised and lowered positions. Although various hitch control systems have been developed in the past and can be utilized in conjunction with the instant invention, the preferred embodiment utilizes a system described in U.S. Pat. No. 4,852,657, issued to Gerald D. Hardy, et al. on Aug. 1, 1989. The specific hitch control means forms no part of the present invention.

Finally, a control means 130 is adapted to receive the desired and actual acceleration signals and responsively modify the manner in which the hitch position is controlled.

Figure 2A:
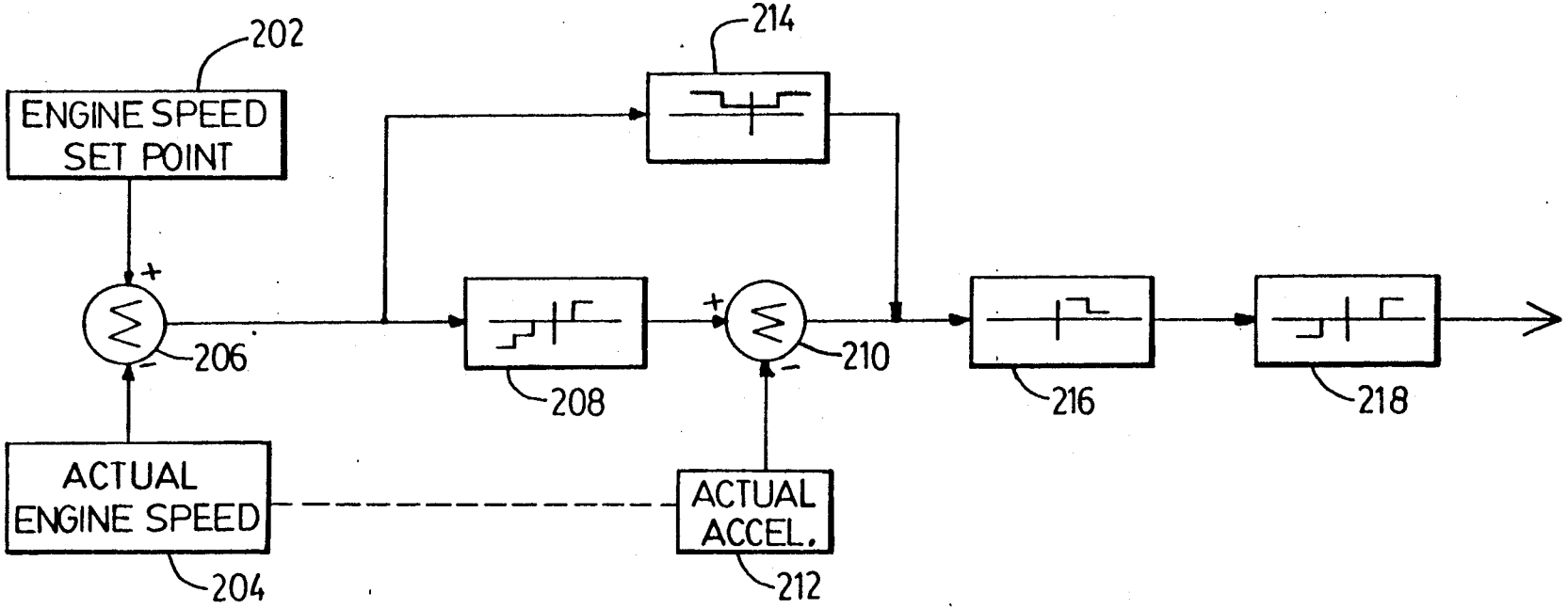
FIGS. 2A and 2B are functional block diagrams of a preferred embodiment of a draft control system for a vehicle such as that shown in FIG. 1.
Figure 2B:
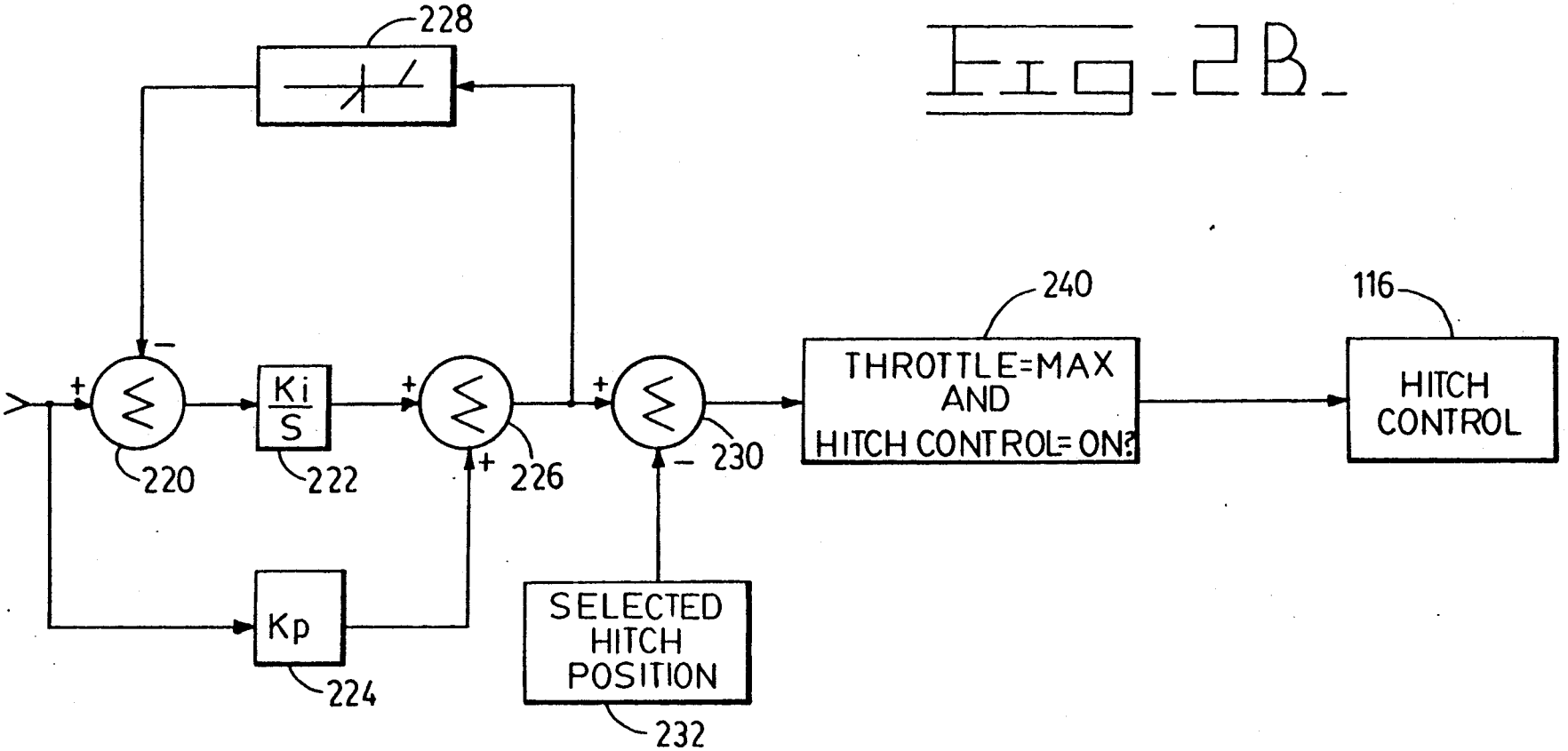
Figure 5:
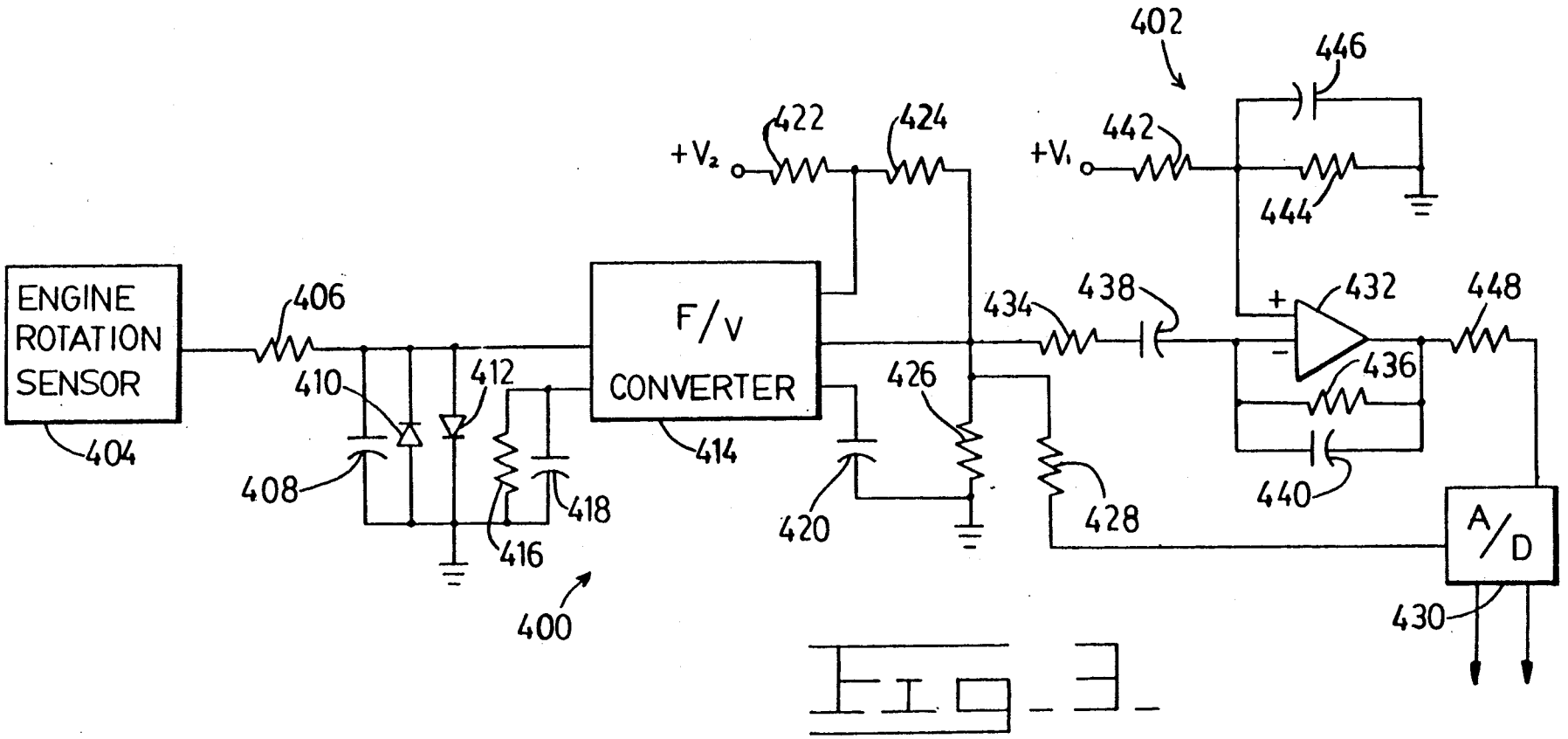

Referring now to FIG. 2, the functions implemented in a preferred embodiment of the instant invention are described in block form. Operation of the draft control apparatus requires determination of actual engine acceleration. This determination can be made in a variety of ways, utilizing either hardware or software techniques. In the preferred embodiment, acceleration is determined in hardware as discussed with reference to FIG. 3.

An engine speed set point value is provided at block 202. In the preferred embodiment, the set point is essentially equivalent to the most desirable working engine speed, for example, 1900 rpm. This set point engine speed value will vary according to the particular vehicle and engine combination with which the draft control apparatus is utilized. The set point can be a single predetermined value, or it can be adjustable by an operator within a selected range. In any event, the set point value is compared or summed with an actual measured engine speed provided by the block 204. The measured engine speed is derived from the second transducer means 114.

A speed error signal is produced at the summing junction 206. Based on the engine speed error, a desired acceleration value is produced. In the preferred embodiment, this is accomplished utilizing a look-up table at the block 208. The look-up table correlates engine speed error values with desired acceleration values. In the block 208, four discrete desired acceleration values are possible depending on the particular magnitude of the engine speed error delivered from the block 206.

The desired acceleration value is delivered to a second summing block 210, which also receives an actual acceleration value from the block 212. The comparison between the desired and actual acceleration produces the acceleration error signal which is delivered from the block 210 and which is modified by a scaling factor in the block 214. The block 214 simply determines how large a gain constant to apply to an acceleration error based on the size of the speed error. In other words, if the speed error signal has a large magnitude, a relatively large gain factor will be applied to the acceleration error to permit correction of engine speed to occur more rapidly. On the other hand, a relatively small speed error will have only small effect on the magnitude of the acceleration error signal. In the preferred embodiment, a speed error of greater than 50 rpm will cause the higher gain constant to be applied to the acceleration error signal.

The acceleration error signal is then delivered to another gain producing element at the block 216. The block 216 is basically a time dependent gain factor that functions only when the operator moves the hitch position selector 110 from a position at which the hitch 106 is fully raised to a position which will cause the hitch 106 to be lowered and the implement 108 to engage the ground. When the earthworking implement 108 first enters the ground, the effect on the vehicle 100 is very rapid and the engine tends to momentarily lug or rapidly decelerate. It is undesirable to effect normal draft control during this highly transient phase of vehicle operation. Therefore, at the block 216, a very high gain is applied to the acceleration signal during the first five seconds of operation following a command by the operator to lower the hitch 106 from a fully raised position. After this initial five second period, the gain is lowered so that the block 216 has no further effect on the control operation.

The acceleration error signal then passes to the block 218 where a deadband is implemented. Assuming that the acceleration error is very small, it is multiplied by zero at the block 218. In other words, the acceleration error signal is removed from the control algorithm if it does not exceed the deadband value. Assuming that the acceleration error is greater than the deadband value, it is multiplied by 1 at the block 218 and passes unchanged.

The acceleration error signal then passes to the summing junction 220 and on to the blocks 222 and 224, where respective integral and proportional gain factors are applied. The resulting signals from the blocks 222 and 224 are again summed at the block 226. This proportional integral (PI) gain portion of the control system is implemented according to conventional control theory. The output signal from the block 226 is fed back to the block 220 through a feedback block 228. The feedback block 228 simply sets limits on the permissible magnitude of the acceleration error signal, preventing the signal from becoming negative or excessively positive.

The resulting acceleration error signal supplied by the summing junction 226 is delivered to the summing junction 230, where it is combined with a selected hitch position from the block 232. The selected hitch position is the command signal provided by the hitch selector 110 as positioned by the operator. In other words, the hitch control means 116 produces signals that directly effect movement of the hitch when the draft control apparatus is not operated. The draft control apparatus controllably modifies the selected hitch position signals by summing them with the acceleration error signal. Therefore, the actual hitch position control signals delivered to the hitch control means 116 cause the hitch to be positioned as commanded by the operator as modified by draft forces on the vehicle implement 108.

In order to provide manual control over the vehicle hitch position, the block 240 is inserted between the summing junctions 226 and 230 to determine whether the draft control is turned "on" and whether the throttle is at a predetermined position, for example, maximum. In the preferred embodiment, this particular combination of selected criteria determines that draft hitch control should be operative. Other conditions could be established for either enabling or disabling the draft control apparatus. If the draft control apparatus is not to be used, the hitch position is controlled directly by the hitch position selector 110.

In the preferred embodiment, actual engine speed and actual acceleration signals are provided by a hardware circuit, as shown in FIG. 3. The hardware circuit includes a speed-to-voltage converter 400 and an analog differentiator 402. An engine rotation sensor 404 supplies a variable frequency signal to the input terminal of the speed-to-voltage converter 400. Engine rotation sensors are well known in the art and can take various forms. One such sensor is responsive to rotation of the engine flywheel, but the exact way in which engine rotation is sensed is of no consequence to the instant invention.

The engine rotation frequency signal is delivered to an input protection circuit made up of a resistor 406, capacitor 408, and a pair of diodes 410,412. This frequency signal is delivered to a frequency-to-voltage converter 414. The gain of the frequency-to-voltage converter 414 is established by a gain resistor 416 connected to the frequency-to-voltage converter 414. A filter capacitor 418 is in parallel with the gain resistor 416. A timing capacitor 420 is also connected to the frequency-to-voltage converter 414.

A set of scaling resistors 422,424,426 is used to scale the output voltage delivered from the frequency-to-voltage converter 414. This output signal is then delivered through an output resistor 428 to an analog-to-digital (A-D) converter 430.

The gain of the frequency-to-voltage converter 414 is established such that an input signal representing 1400 revolutions per minute of the engine produces a zero output voltage at the output terminal of the frequency-to-voltage converter 414. A full scale or maximum voltage output signal is produced at the output of the frequency-to-voltage 414 converter in response to an input signal representing 2300 revolutions per minute. This linearly variable output signal is delivered to the A-D converter 430 where it is converted to a digital signal suitable for processing by the microprocessor associated with the draft control apparatus. In FIG. 2, this signal from the A-D converter 430 is the actual engine speed signal shown at block 204.

The output signal from the frequency-to-voltage converter 414, representing the actual instantaneous engine speed, is also delivered to the inverting input terminal of an operational amplifier 432. Timing components associated with the operational amplifier 432 and forming part of the analog differentiator 402 include a pair of resistors 434,436 and a pair of capacitors 438,440. A voltage divider made up of a pair of resistors 442,444 serially connected between a source of positive voltage and ground provides a reference voltage to the non-inverting input terminal of the operational amplifier 432. A filter capacitor 446 is connected in parallel with the resistor 444 to ground.

The analog differentiator 402 is structured such that the voltage delivered at the output terminal of the operational amplifier 432 will be 2.5 volts in response to zero acceleration of the engine, based on no deviation of the engine speed supplied signal from the speed-to-voltage converter 400. The gain of the analog differentiator 402 is such that, in the preferred embodiment, as engine acceleration approaches 300 rpm per second, the output voltage from the operational amplifier 432 approaches zero volts. Conversely, as the engine acceleration approaches a negative 300 rpm per second, the output voltage from the analog differentiator 402 approaches 5 volts. The differentiated engine speed signal, i.e. the engine acceleration signal, is delivered through a resistor 448 to the A-D converter 430 and the resulting digital signal is provided for use by the draft control apparatus. This is shown in block form in FIG. 2 at the actual acceleration block 212.

Figure 4A:
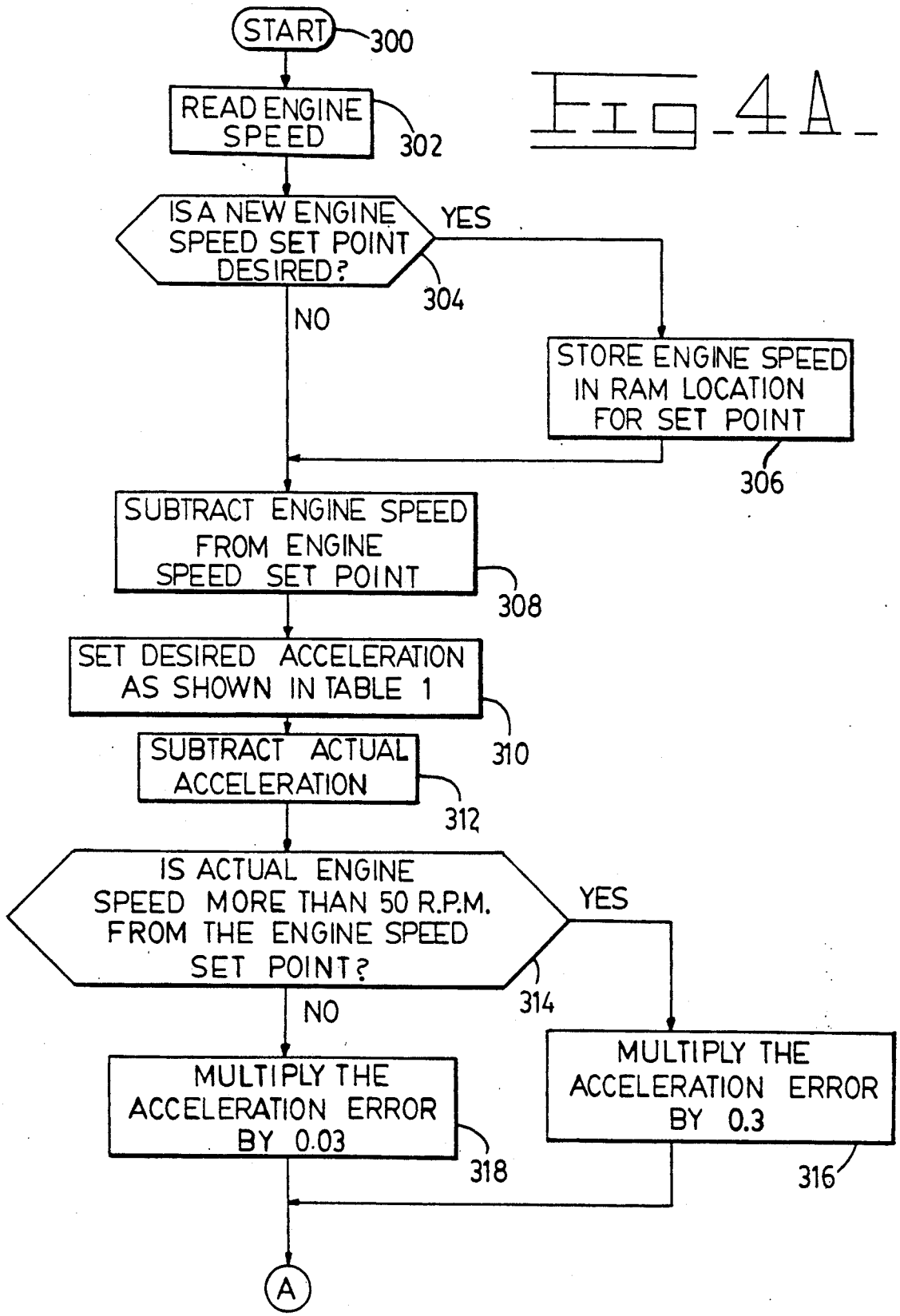

FIG. 4 details a flowchart which defines the internal programming for the draft control apparatus which is implemented in software. From this flowchart, a programmer with ordinary skill can develop a specific set of programming instructions that performs the steps necessary to implement the preferred embodiment of the invention. While the best mode of the invention is considered to include a properly programmed processor, the result of which is the creation of novel hardware associations within the processor and its associated devices, it is possible to implement the apparatus using conventional hardware and circuit elements.

Beginning at the start block 300, the actual engine speed is determined in the block 302. It is then determined whether a new engine speed set point is desired in the block 304. If so, the present actual engine speed is stored as the set point value in the block 306, and program control passes to the block 308. If no new set point is desired at the block 304, control passes directly to the block 308. The draft control system can also be implemented in such a manner that the engine speed set point is not variable, in which case control can progress directly from the start block 300 to the block 308. In addition, other means can be utilized for establishing the engine speed set point, such as a calibrated dial or moveable lever.

Regardless of how the engine speed set point is initially established, at the block 308 the actual engine speed is subtracted from the engine speed set point value. Based on the resulting engine speed error signal produced, a desired acceleration value is determined in the block 310. In the preferred embodiment, this is accomplished utilizing the table discussed above with regard to FIG. 2. The actual acceleration value is then subtracted at the block 312 from the desired acceleration value, producing an acceleration error signal.

At the block 314, the magnitude of the engine speed error signal is examined. If the engine speed is more than 50 rpm from the engine speed set point value, the acceleration error value is multiplied by a factor of 0.3 at the block 316. If the actual engine speed is not more than 50 rpm from the engine speed set point, the acceleration error value is instead multiplied by 0.03 at the block 318.

In either case, the control then passes to the block 320 where the resulting magnitude of the acceleration error signal is examined to determine whether it is less than 2.35. If so, the acceleration error value is set to 0 at the block 322 and control passes to the block 324. If the magnitude is not less than 2.35, control passes directly to the block 324. The blocks 320 and 322 implement the deadband element as discussed above.

At the block 324, it is determined whether the hitch position selector 110 has been lowered from the fully raised position during the last five seconds of operation. If so, the acceleration error signal is multiplied by a factor of 10.0 at the block 326, and control passes to the PI section of the flowchart. If the selector 110 has not been lowered from the fully raised position during the last five seconds, control passes directly to the PI section.

In the PI section of the program, proportional and integral factors are applied to the acceleration error signal in the respective blocks 328 and 330. The signal is then integrated in the block 332 and the proportional and integral portions of the signal are recombined in the block 334. The acceleration error signal magnitude is limited to allow modification of the hitch position control signals to occur only between 0 and 86 percent of the upward hitch command direction of the hitch position selector travel. This occurs in the block 336 and prevents driving the hitch in a downward direction below the position established by the operator utilizing the hitch position selector 110. In addition the hitch cannot raise more than 86 percent of the maximum hitch travel, thereby reducing the likelihood that the control will completely remove the implement from the ground.

Next, at the block 338, the throttle position and draft control switches are examined. If either the throttle is not at the maximum position or the draft control switch is not turned "on", control loops to the return block 342 and back to the start block 300. Assuming that the throttle is at maximum and the draft control switch is "on", then control passes to the block 340, where the hitch position control signals are modified by combining them with the acceleration error signal to produce a modified error signal. This signal is delivered to the hitch control means 116 to effect a change in the hitch position.

Industrial Applicability

Operation of the draft control apparatus is best described in relation to its use on a vehicle 100 such as an agricultural tractor having a hitch 106 and an associated earthworking implement 108. The operator selects a desired implement penetration depth utilizing the hitch position selector 110 and adjusts the throttle 104 to select maximum engine speed in a particular gear range.

Assuming that the maximum throttle position is selected and that the draft control system is turned "on", the apparatus then determines acceleration error and controllably modifies the hitch 106 and earthworking implement 108 position in response to changes in engine acceleration values. By utilizing acceleration and deceleration rates as opposed to mere changes in engine speed, the draft control system is able to anticipate the magnitude of implement position modification that is required to react to the soil conditions being encountered without producing instability in the control system. Therefore, the draft control apparatus automatically operates at an optimum gain and is as responsive as can be without need for the operator to manually establish various system gain factors or to decrease the effectiveness of the control system by reducing gain to the point where instability cannot occur.

Advantageously, the operator simply selects the desired implement depth and vehicle gear range and proceeds to work the soil without being concerned about fine-tuning the draft control system. The draft control system automatically modifies the implement depth in response to the working conditions. If the depth is not sufficient for the intended purpose, a lower gear range can be selected to permit deeper implement penetration.

The present system is simple and reliable without need for external controls or complex operating instructions. Other aspects, objects, advantages, and uses of this invention can be discerned from a study of the drawings, the disclosure, and the appended claims.

We claim:

1. A draft control apparatus for an earthworking vehicle, the vehicle having an engine responsive to an engine throttle and a hitch connectable to an earthworking implement, the hitch being connectable to the vehicle and controllably movable between raised and lowered positions in response to hitch position control signals, comprising:

command means for producing a desired engine acceleration signal;

acceleration determining means for producing an actual engine acceleration signal; and, control means for receiving said desired and actual engine acceleration signals, responsively producing an acceleration error signal, and controllably modifying said hitch position control signals in response to said acceleration error signal.

2. A draft control apparatus, as set forth in claim 1, wherein said command means includes set point means for establishing a desired engine speed, speed transducer means for producing an actual engine speed signal, speed error detection means for comparing said actual engine speed signal with said desired engine speed set point and responsively producing an engine speed error signal, and means for producing said desired engine acceleration signal in response to said engine speed error signal.

3. A draft control apparatus, as set forth in claim 2, wherein said desired engine acceleration signal is responsive to the magnitude of said engine speed error signal.

4. A draft control apparatus, as set forth in claim 3, wherein said means for producing said desired engine acceleration signal includes a look-up table adapted to relate the magnitude of said engine speed error signal to one of a plurality of desired engine acceleration signals.

5. A draft control apparatus, as set forth in claim 1, wherein said control means includes scaling means for modifying said acceleration error signal by a factor responsive to the magnitude of said engine speed signal.

6. A draft control apparatus, as set forth in claim 1, wherein said control means includes means for modifying said acceleration error signal by applying proportional and integral factors to said acceleration error signal.

7. A draft control apparatus, as set forth in claim 1, including means for sensing the position of said throttle, and wherein said control means modifies said hitch position control signals only in response to said throttle being at a predetermined position.

8. A draft control apparatus, as set forth in claim 7, wherein said engine operates at a predetermined desirable speed in response to said throttle being at said predetermined position.

9. A draft control apparatus, as set forth in claim 1, wherein said modified hitch position control signals cause said hitch to move upwardly in response to deceleration of said engine.

10. A draft control apparatus, as set forth in claim 9, wherein said modified hitch position control signals cause said hitch to move downwardly in response to acceleration of said engine.

11. A draft control apparatus, as set forth in claim 10, wherein the rate at which said hitch moves upwardly and downwardly is responsive to the respective rates of deceleration and acceleration of said engine.

12. A draft control apparatus, as set forth in claim 1, wherein said control means includes limiting means for preventing modification of said hitch position control signal to a value less than the unmodified value of said hitch position control signal, whereby downward movement of said hitch below the position indicated by the unmodified hitch position control signal is inhibited.

13. A method for providing draft control on an earthworking vehicle, the vehicle having an engine responsive to an engine throttle and a hitch connectable to an earthworking implement, the hitch being connectable to the vehicle and controllably movable between raised and lowered positions in response to hitch position control signals, comprising the steps of:

producing a desired engine acceleration signal;

producing an actual engine acceleration signal; and, receiving said desired and actual engine acceleration signals, responsively producing an acceleration error signal, and controllably modifying said hitch position control signals in response to said acceleration error signal.

* * * * *